US006985789B2

(12) United States Patent
Carlson et al.

(10) Patent No.: US 6,985,789 B2
(45) Date of Patent: Jan. 10, 2006

(54) REAL-TIME DETERMINATION OF WEB TENSION AND CONTROL USING POSITION SENSORS

(75) Inventors: Daniel H. Carlson, Arden Hills, MN (US); Thomas M. Clausen, Minneapolis, MN (US); John T. Strand, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/743,206

(22) Filed: Dec. 22, 2003

(65) Prior Publication Data

US 2005/0137738 A1 Jun. 23, 2005

(51) Int. Cl.

| | |
|---|---|
| ***G06F 19/00*** | (2006.01) |
| ***B23Q 15/00*** | (2006.01) |
| ***B23Q 16/00*** | (2006.01) |
| ***B65H 26/00*** | (2006.01) |
| ***B65H 43/08*** | (2006.01) |

(52) U.S. Cl. ..... 700/122; 226/24

(58) Field of Classification Search ..... 700/122; 226/24, 42

See application file for complete search history.

(56) References Cited

U.S. PATENT DOCUMENTS

| | | | | |
|---|---|---|---|---|
| 4,102,183 | A | | 7/1978 | Thenander |
| 4,182,168 | A | | 1/1980 | Desch |
| 4,487,079 | A | | 12/1984 | Compton et al. |
| 4,566,340 | A | | 1/1986 | Compton et al. |
| 5,019,017 | A | | 5/1991 | Mönch |
| 5,159,841 | A | | 11/1992 | Montalvo, III et al. |
| 5,225,785 | A | | 7/1993 | Mayer et al. |
| 5,257,550 | A | | 11/1993 | Montalvo, III et al. |
| 5,480,085 | A | * | 1/1996 | Smithe et al. ..... 226/44 |
| 5,490,639 | A | * | 2/1996 | Droutsas ..... 242/525.1 |
| 5,628,227 | A | | 5/1997 | LaPlante |
| 5,754,361 | A | * | 5/1998 | Sakai et al. ..... 360/95 |
| 5,809,917 | A | * | 9/1998 | McGowan et al. ..... 112/80.32 |
| 6,068,206 | A | * | 5/2000 | Lindsay, Jr. ..... 242/334.3 |
| 6,122,978 | A | | 9/2000 | Callendrier |
| 6,250,146 | B1 | | 6/2001 | Callendrier |
| 6,360,596 | B1 | | 3/2002 | Callendrier |
| 6,517,679 | B1 | | 2/2003 | Mustonen et al. |
| 6,585,685 | B2 | * | 7/2003 | Rajala et al. ..... 700/122 |
| 6,715,708 | B2 | * | 4/2004 | Wood ..... 242/485.5 |
| 6,845,282 | B2 | * | 1/2005 | Franz ..... 700/122 |
| 2003/0188661 | A1 | * | 10/2003 | Fischer ..... 101/485 |

* cited by examiner

*Primary Examiner*—Leo Picard
*Assistant Examiner*—Ryan Jarrett
(74) *Attorney, Agent, or Firm*—Rick L. Pranzen

(57) ABSTRACT

Web tension in web material passing through a web transport system is determined in real time using position sensors coupled to driven rollers that define a beginning and an end of a tension zone. The position sensors on the rollers provide information related to the amount of strained web material that has been added and subtracted from the web material present in the tension zone. The amount of web material added to, subtracted from and present in the tension zone in a sample time period is then converted to an unstrained amount of web material that when combined provides an estimate for the present amount of unstrained web material present in the tension zone. Because the length of the tension zone is both fixed and known, the tension in the web material is determined from the present amount of unstrained web material in the tension zone.

37 Claims, 3 Drawing Sheets

REAL-TIME DETERMINATION OF WEB TENSION AND CONTROL USING POSITION SENSORS

TECHNICAL FIELD

The invention relates to techniques for determining web tension within manufacturing processes.

BACKGROUND

Continuous feed manufacturing systems, such as manufacturing systems used to produce paper, film tape, and the like, often include one or more motor-driven rotatable mechanical components, such as rollers, casting wheels, pulleys, gears, pull rollers, extruders, gear pumps, and the like. These systems often include electronic controllers that output control signals to engage the motors and drive the motors at pre-determined speeds. A typical controller often includes sophisticated closed-loop control circuitry that monitors the speed of the motor and adjusts the output signals to compensate for any detected error.

Web tension is one of the most critical parameters in the manufacturing and handling of web-based products. Web tension is generally related to variations in the speed of the web material as it travels through a set of driven rollers within a continuous feed manufacturing system. Conventional tension sensing devices employ various types of strain gauges, mounted onto physical beams or structures machined to enhance strain changes under tension loading. Typical configurations employ a roller wrapped by the web at an angle to translate the web tension into proportional forces on the structure. These forces, in turn, induce a strain in the gauge, allowing tension measurement.

These tension-sensing devices typically differ on methods of mounting, and methods of beam or gauge design to improve accuracy. For many applications, the required wrapping of a roller is unachievable as characteristics of the web may require that it not be contacted on its surface as it may lead to scratching, marring, smearing, and other surface finishing defects. In addition, small wrap angles reduce surface traction and the ability to drive the roller with the web, thereby increasing the likelihood of material scratching. Laminated products may have relative layer creep due to unequal path length from bending on the roller of a conventional tension sensor. Bending of thick or multi-layer constructed products can induce defects, such as delamination.

In some instances, the geometry to achieve the required wrap is awkward or impossible due to characteristics of the web or spatial limitations of the manufacturing environment. The use of highly accurate tension sensors may reduce this angle, but it is still a significant limitation. In addition, small wrap angles reduce surface traction and the ability to drive the roller with the web, thereby increasing the likelihood of material scratching.

In other instances, variations in speed have been used to determine an approximate, long-term average for web tension within continuous feed manufacturing systems. This concept, generally referred to as draw control, is well known and has been employed in web handling systems for many years. Although draw control can estimate tension at sufficiently high web speeds and over long enough measurement duration, it does not permit real-time determination of web tension. As such, draw control has not been useful within control applications that utilize web tension as a control factor. In addition, draw control is inherently an open lop strategy, i.e. the velocity of the rolls are controlled, but the tension is always estimated from the draw, and never with sufficient accuracy to control based on the measured draw. Specifically, draw techniques typically make assumptions regarding the actual web material velocity as it passes through the system. As such, position information relating to the movement of the web as it relates to velocity, tension and any other web material parameter is not obtained. No real-time estimate of web tension and its related parameters may therefore be determined using draw as the needed information is not obtained from the rollers and other system components. The present invention attempts to overcome these limitations in the prior art.

SUMMARY

In general, the invention relates to techniques for determining web tension and modulus sensing within a web transport system. More specifically, techniques are described for calculating a respective web tension within one or more spans of the web transport system in real-time using high-resolution position feedback sensors.

A traditional tension sensor is used to physically measure tension within an upstream span within the web transport system. The initial direct tension measurement is required because the existing level of strain in the web from the previous process is generally not known. If the actual value of strain was known, it could be used directly. Web tensions within downstream spans are calculated in real-time based on the upstream measured web tension and position signals received from the position feedback sensors. In particular, a web tension for a span between two rollers downstream from the tension sensor is calculated in real-time based on the web tension measured upstream and position signals received from position sensors within the rollers. A controller, for example, receives the position signals from the position sensors, and continuously determines any change to the amount of web within the span. Based on any changes to the amount of material and the web tension measured upstream, the controller calculates the web tension for the downstream span.

The controller may apply this process to calculate web tensions for a plurality of downstream spans within the web transport system using only the single tension sensor. Moreover, high-resolution sensors are often used in modern web-transport systems for velocity and position control. Consequently, the techniques described herein may allow web tension to be determined in real-time without requiring the use of additional hardware, thereby saving costs associated with the multiple commercial tension systems, any rollers that may be additionally required, web path modifications, and installation. For example, the described techniques may be implemented primarily in software executing on a drive system for the web-transport system, or in a remote controller communicating with the drive system via an industrial network.

In addition, the techniques may be applied in alternate configuration to provide the capability to directly calculate web properties in real-time. For example, the techniques may be applied to calculate web properties such as modulus, thickness, area or other properties.

In one embodiment, the invention is directed to a method for controlling web tension and modulus sensing within a web transport system. The method calculates tension for a segment of web material in real time, the segment of web material being a tension zone having a length and controlling a first actuator control signal for a first roller as a function of the tension.

In another embodiment, the invention is directed to a method for determining web tension and modulus sensing within a web transport system. The method determines an unstrained amount of web material added to the tension zone in a time period, the time period having a beginning and an end, determines an unstrained amount of web material in the tension zone at the beginning of the time period, and determines an unstrained amount of web material subtracted from the tension zone in the time period. The method then combines the unstrained amount of web material added to the tension zone, unstrained amount of web material in the tension zone, and unstrained amount of web material subtracted from the tension zone to determine an amount of web material in the tension zone at the end of the time period, divides the amount of web material in the tension zone at the end of the time period by the length of the tension zone to determine a current strain for the web material, and converting the strain for the web material to tension.

In another embodiment, the invention is directed to a computer-readable medium containing instructions. The instructions cause a programmable processor to receive a first position corresponding to a position of a first roller, receive a second position corresponding to a position of a second roller, and calculate a tension for a segment of web material in real time using the first position and the second position, the segment of web material being a tension zone having a length.

In another embodiment, the invention is directed to a system for determining web tension and modulus sensing within a web transport system. The system comprises at least two position sensors generating at least two position signals and a controller module that calculates in real time a tension for web material in a tension zone based upon the two position signals. The tension zone being the web material between the rollers coupled to the at least two position sensors and each position sensor being coupled to a roller in a web transport system.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
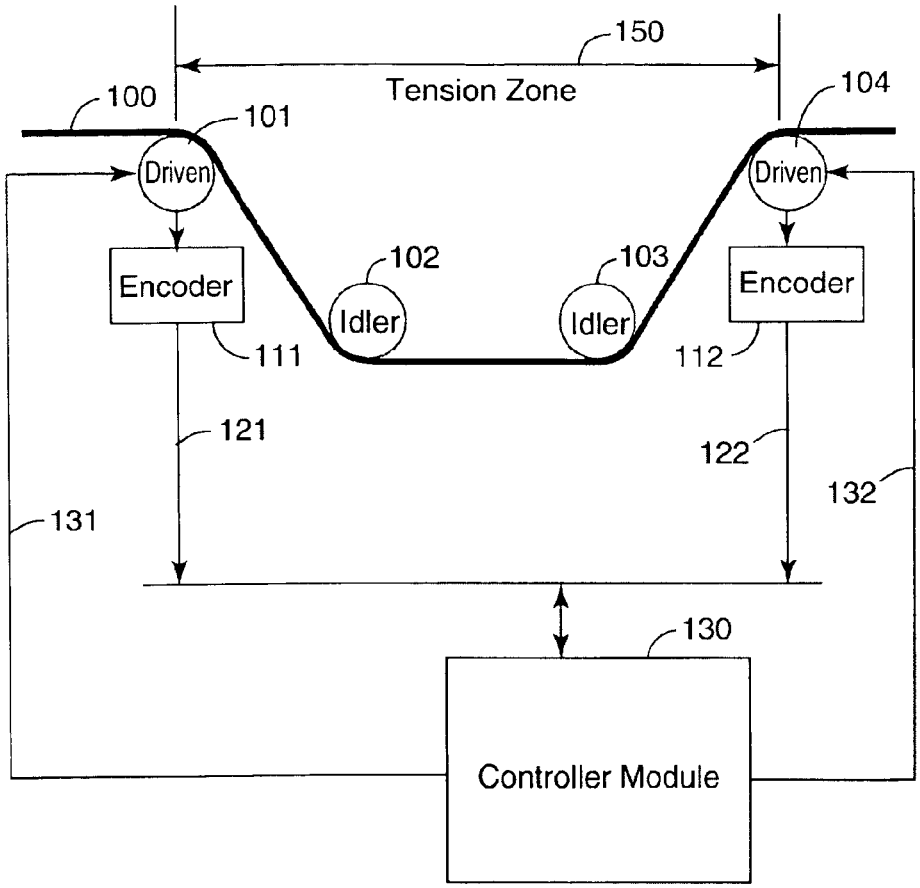
FIG. 1 is a block diagram illustrating a web-based manufacturing system operating in accordance with techniques described herein.

FIG. 1 is a block diagram illustrating a portion of a web-based manufacturing system operating in accordance with principles of the invention. In this particular example, a segment of a web transport system, which is typically referred to as a tension zone 150, is shown that contains two driven rollers and a number of idler rollers that moves web material 100 through the web transport system. The driven rollers are coupled to drive motors that rotate to move the web material 100 at a desired speed. A controller module 130 collects position data from encoding sensors that indicate an angular position of the rollers to provide data relating to the amount of rotation that has occurred by the rollers. Because the rollers rotate in direct proportion to the amount of web material that has passed through a roller, data from these sensors may be obtained that indicates the amount of web material added to and subtracted from the tension zone 150 between the two driven rollers 101, 104.

During operation, web material 100 enters the tension zone 150 from the left onto a first roller 101 to which a position sensor 111 is attached. Second and third undriven rollers 102–103 are idler rollers, i.e., undriven rollers, used to obtain a desired physical web path configuration through the web transport system. A fourth roller 104 is located at the exit of this tension zone 150, and also has a position sensor 112. Any of these rollers may be driven, although in a typical configuration only the entering and exiting rollers would be driven. In addition, any or all of these rollers may be idler rollers while still operating according to principles of the invention. While only two idler rollers 102–103 are shown, any number of rollers may be used to obtain the desired web path configuration.

In accordance with the techniques described herein, controller module 130 of the web-based manufacturing system receives positions signals 121, 122 from position sensors 111–112, and calculates various parameters of web material 100 within tension zone 150 in real-time based on the signals. Various embodiments of the techniques described herein allow parameters, such as web tension, elastic modulus, thickness, and width, to be accurately determined in real-time. High-resolution position sensors produce position signals 121–122 that allow controller module 130 to accurately determine the changes in position of driven or undriven web transport rollers 101 and 104. Controller module 130 may then accurately determine the web parameters as feedback data for use in real-time control of web transport system.

More specifically, based on position signals 121–122 received from the position sensors 111–112, controller module 130 determines the amount of web material 100 that has been added to and subtracted from the web zone 150 during any given sample period. From a prior determination of the amount of web material 100 in the tension zone 150 at the start of the sample period, controller module 130 determines the amount of web material 100 in the tension zone at the end of the sample period. Because the span of the tension zone 150 is both fixed and known, controller module 130 determines the amount of strain in web material 100 from these data values, as discussed in more detail below. Once a current measurement of web strain is determined, other web parameters may be easily determined, such as web tension, modulus, elastic modulus, thickness, and width.

Based on the determined parameters, controller module 130 controls actuator control signals 131–132 in real-time. For example, actuator control signal 131 may control a drive motor (not shown) of roller 101. Similarly, actuator control signal 132 may control a drive motor (not shown) of roller 102. As such, controller module 130 may control roller 101 as a mechanism to control the tension in the web material 100 within tension zone 150.

The above embodiment utilizes the determination of the web tension to control the tension in the web material 100 as it passes through the web-based manufacturing system. The web tension determined in the above web-based manufacturing system may also be used in other manners. For example, the velocity and torque of the driven rollers 101, 104 that affect the web tension may be controlled using the web tension value determined in the above-described system. Similarly, a span length that is defined as the length between the two driven rollers 101, 104 may also be varied using the determined value for the web tension. Finally, the web tension value determined by the above system may be displayed to an operator in order that the operator varies an operating parameter of the web-based manufacturing system. Of course, many other well known system parameters associated with the web-based manufacturing system may be controlled as function of determination of a web parameter according to the present invention. As such, the above system may be viewed in some embodiments as a web sensor system that generates a value for an observed web parameter, such as tension or modulus, in the web material 100 for use in any other application within such a system.

Controller module 130 is a generally programmable processing system for use in a web transport controller in accordance with an example embodiment of the present invention. Controller module 130 typically includes a programmable processing unit, mass memory, and various interface modules for communication with external devices, all connected via an internal bus.

The mass memory generally includes RAM, ROM, and may include one or more mass storage devices, such as a removable memory device such as a Compact Flash, Smart Media, or Secure Digital memory card. The memory devices may store an operating system for controlling the operation of controller module 130. It will be appreciated that this component may comprise a general purpose server operating system as is known to those of ordinary skill in the art, such as UNIX, MAC OS™, LINUX™, or Microsoft WINDOWS®. The mass memory also stores program code and data for providing a web transport controller-processing program. The web transport controller-processing program includes computer executable instructions which are executed to perform the logic described herein.

Controller module 130 may also comprises input/output sensor interface for communicating with external devices, such as high-resolution encoders 111–112 or other input devices not shown in FIG. 1. Likewise, controller module 130 may further comprise additional mass storage facilities also not shown should additional data storage be needed.

One skilled in the art will recognize that the processing system illustrated within controller module 130 may represent a set of processing components typically found within a web transport controller or similar dedicated processing system. Of course, other processing systems including general purpose computing systems containing additional peripherals and user interface devices may also be used to implement the programmable processing according to various embodiments of the present invention without deviating from the spirit and scope of the present invention as recited within the attached claims.

The invention may also be described in the general context of computer-executable instructions, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Additionally, the embodiments described herein are implemented as logical operations performed by a programmable processing device. The logical operations of these various embodiments of the present invention are implemented (1) as a sequence of computer implemented steps or program modules running on a computing system and/or (2) as interconnected machine modules or hardware logic within the computing system. The implementation is a matter of choice dependent on the performance requirements of the computing system implementing the invention. Accordingly, the logical operations making up the embodiments of the invention described herein can be variously referred to as operations, steps, or modules.

Figure 2:
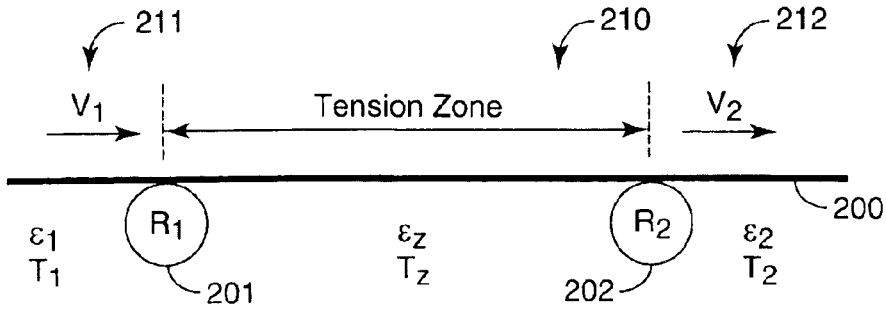
FIG. 2 is a block diagram illustrating a representation of a single tension zone within a web-based manufacturing system according to the techniques described herein.

FIG. 2 is a block diagram of a single tension zone 210 within a web-based manufacturing system. In this illustration, web material 200 passes through tension zone 210 formed by rollers 201 and 202. In general, the terms "tension zone" and "span" are used herein in reference to a section of a web contained between components of the web-based manufacturing system, e.g., rollers 201 and 202. There are generally additional idler rollers, as shown in FIG. 1, within a particular tension control zone 210.

Web material 200 enters tension zone 210 from an "upstream" tension zone 211 with an initial strain $\epsilon_1$ and velocity $V_1$. The tension is related to the strain based on the web modulus and sectional area of web material 200, as will be shown below. In the simplified diagram shown in FIG. 2, the web material 200 contacts a first roller $R_1$ 201. Although not illustrated for simplification reasons, in general, web material 200 wraps roller 201 at an angle from a few degrees up to a reasonable maximum of about 180 degrees. This angle of wrap for the web material 200 is generally limited by reasonable and practical web transport geometry. As long as the tension differential across a roller is less than the available traction, the web material 200 is pinned to the roller 201 at least at one point, and a point contact is a reasonable approximation for analysis. Web tension, wrap angles, roller diameters, web speeds, roller surface finish, and web properties (roughness, porosity) may also affect available web traction required to maintain firm contact with the roller. Vacuum or nipped pull rollers may also be used to increase traction if necessary.

The web material 200 makes contact with first roller $R_1$ 201 and the web material 200 is initially pinned to the first roller $R_1$ 201. However, as web material 200 approaches the point where it exits first roller $R_1$ 201, web material 200 begins to slide as well and change its strain and velocity. In particular, these values match the velocity and strain in the downstream tension zone, i.e., tension zone 210, once the web no longer contacts the first roller $R_1$ 201 (local web strain non-uniformities are redistributed in a free span at speeds on the order of the speed of sound in the material). Web material 200 leaves the tension zone 210 after a second roller $R_2$ 202 and, as before, web material 200 is initially pinned to the second roller 202 with strain $\epsilon_z$ and tension $T_z$. After the web material 200 no longer contacts the second roller surface, the material 200 again changes velocity and strain to match $V_2$ and $\epsilon_2$ in an exiting tension zone 212.

To analyze the tension zone dynamics, a generalized definition of the modulus of elasticity may be used. This generalized definition of the modulus of elasticity is defined as:

Equation 1:

$$E = \frac{\sigma}{\varepsilon}.$$

Equation 1 states that the modulus of tensile elasticity is equal to the ratio of the stress in web material 200 to the strain in the web material. Stress and strain are defined as:

Equations 2A:

$$\text{stress } \sigma = \frac{F}{\text{area}} \text{ and}$$

Equations 2B:

$$\text{strain } \varepsilon = \frac{\Delta\text{Length}}{\text{Length}}, \text{ respectively.}$$

The stress of web material 200 is equal to the elongation force applied, normally in Lbs force (SI Newtons), divided by the sectional area, often in inches$^2$ (SI m$^2$). Therefore the net units of stress are usually lbs per square inch, or PSI (SI Pascals). Strain is the resulting change in length resulting from the applied force, divided by the initial unstrained (or zero strain) length. Its units are inch per inch, or dimensionless. Therefore, the resulting units for E are usually expressed in PSI (SI Pascals).

The relationship between web tension and strain may be determined as follows:

Equation 3:

$$E = \frac{\sigma}{\varepsilon} = \frac{\frac{F}{\text{area}}}{\varepsilon}.$$

The area is the web cross sectional area, or the width of web material 200 multiplied by its average thickness. Note that the force is the instantaneous tension:

Equation 4:

$$T = E \times A \times \varepsilon \text{ or}$$

$$E = \frac{\frac{T}{\text{area}}}{\varepsilon}.$$

Equation 4 provides a quick method to predict tension given strain, as modulus E and web area are generally fixed. In some processes, such as moisturization of paper, annealing of films and steel, etc. the material modulus may be changed by the process. In conjunction with a traditional tension sensor, another embodiment of the invention allows online measurement of modulus.

An analytical solution to evaluate the strain of a web zone with differing velocities can be specified by:

Equation 5:

$$\frac{1}{1+\varepsilon_2} = \frac{V_1}{V_2}\left(\frac{1}{1+\varepsilon_1}\right) + \left[\frac{1}{1+\varepsilon_1(0)} - \frac{V_1}{V_2}\left(\frac{1}{1+\varepsilon_1}\right)\right]e^{-\frac{V_1 t}{L_2}}.$$

where $L_2$ is the span length. In all equations described herein, subscript 1 refers to pre-entry span, and subscript 2 refers to the span between driven rollers.

A solution to Equation 5 suitable for implementation within a digital controller in real time may be obtained by numerically integrating equation 5. To calculate the tension in tension zone 210, the stress-strain relationship of Equation 1 is used over small intervals of time. Initially, the assumption is made that the incoming strain and velocity are held constant, and that the exiting web strain and velocity are also held constant. Also the assumption is made that the present strain in tension zone 210 is equal to the incoming strain of upstream tension zone 211. These assumptions imply that the three tension zones 210–212 have equal tensions, as modulus and web areas are equal.

Now allow $V_2$ to change instantaneously to $V_2+\Delta V$. To calculate the tension in the tension zone 210, the instantaneous strain is first calculated. In general, this may be calculated by the following procedure, as described in more detail below:

1. Calculate the unstrained length of web material 200 added to tension zone 210,
2. Calculate the unstrained length of web subtracted from tension zone 210,
3. Calculate a previous length of unstrained web material 200 that was in the zone,
4. Calculate present length of web material 200 in tension zone 210 based on the previous unstrained length plus the unstrained length added minus the unstrained length removed,
5. Divide the calculated present length by a zone length of tension zone 210 to determine a present strain, and
6. Use Equation 3 to calculate a present tension for web material 200 within tension zone 210 based upon the present strain.

The above procedure presents two challenges: an unstrained web length is used, and a value for the current strain in tension zone 210 changes. To address the first challenge identified above, a method to relate unstrained length to a known parameters is used. The second challenge, i.e., computation of the changing current strain, is addressed below with respect to FIG. 3.

To relate unstrained length to a known parameter, recall that strain is defined above in Equation 2 as:

$$\text{strain } \varepsilon = \frac{\Delta\text{Length}}{\text{Length}}.$$

This may be re-formulated as

Equation 6:

$$\text{strain } \varepsilon = \frac{L - L_0}{L_0},$$

where L is the present length and $L_0$ is the initial unstrained length. This may be re-stated as:

Equation 7:

$$\text{strain } \varepsilon = \frac{L - L_0}{L_0} = \frac{L}{L_0} - \frac{L_0}{L_0} = \frac{L}{L_0} - 1, \quad \text{or}$$

Equation 8:

$$\frac{L}{L_0} = 1 + \varepsilon \text{ and}$$

Equation 9:

$$\frac{L_0}{L} = \frac{1}{1+\varepsilon} \approx 1 - \varepsilon \text{ (when } \varepsilon << 1).$$

Note that $\epsilon$ is typically less than 1%. The error of using $1-\epsilon$ instead $$\frac{1}{1+\varepsilon}$$

causes very little error for common strains (<0.01% error), which may be acceptable in some embodiments. The resulting errors are summarized in Table 1.

TABLE 1

| $\epsilon$ | $\frac{1}{1+\varepsilon}$ | $1-\epsilon$ | Error |
|---|---|---|---|
| 0.01 | 0.990099 | 0.990000 | 0.01% |
| 0.001 | 0.999001 | 0.999000 | 0.0001% |
| 0.0001 | 0.999900 | 0.999900 | 0.000001% |

The relationship between unstrained length, present length, and strain may now be conveniently summarized as:

$$L=L_0\times(1+\epsilon) \text{ and } L_0=L\times(1-\epsilon). \qquad \text{Equation 10}$$

Because the above equations refer to tensile strain, $\epsilon$ is greater than 0, and L is always greater than $L_0$. This helps to ensure proper sign of strain. The exact relationship may also be used instead of the approximation where high strains or high accuracies are required.

Figure 3:
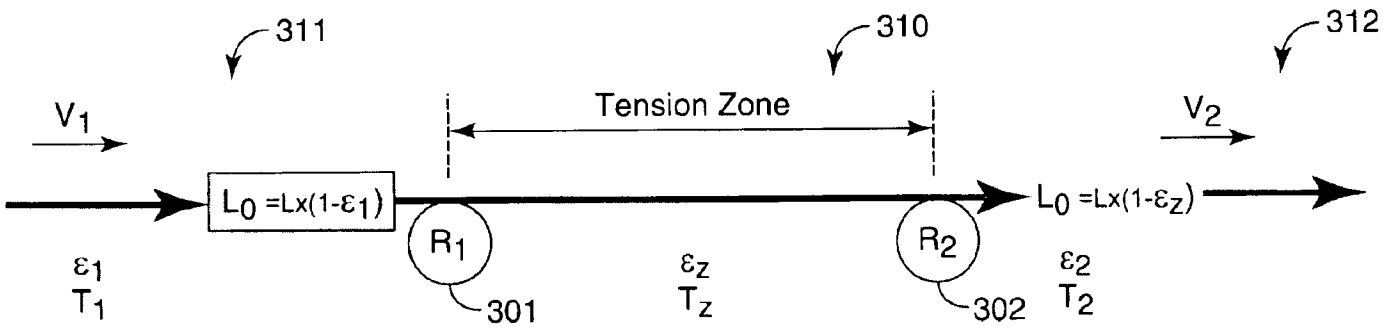
FIG. 3 is a block diagram illustrating another representation of a single tension zone within a web-based manufacturing system.

FIG. 3 is a block diagram illustrating a single tension zone within a web-based manufacturing system according to an embodiment of the invention. In particular, using the above equations, the representation shown by FIG. 2 may now be modified to include the effects of strain on web length, as shown in FIG. 3.

To determine the tension $T_Z$ within tension zone 310, three web material lengths are determined. First, the length of unstrained web material 300 added to tension zone 310 is determined. In particular, the length of strained web material 300 added is $V_1$ times the time interval $\Delta t$. The unstrained web added is determined using the equation $V_1\cdot\Delta t\cdot(1-\epsilon_1)$. Next, the unstrained web subtracted from tension zone 310 is determined. The strained web subtracted is $V_2$ times the time interval $\Delta t$. The unstrained web removed is determined using the equation $V_2\cdot\Delta t\cdot(1-\epsilon_z)$. Finally, the previous amount of unstrained web that was in tension zone 310 is determined. Let $L_{zs}$ represent the strained length of web material in tension zone 310. The unstrained length $L_{zu}$ can, therefore, determined by the equation $L_{zs}\cdot(1-\epsilon_z)$. These three lengths may be determined in any order before the total length of web material 300 currently present within tension zone 310 is determined. In particular, the current unstrained length of web material 300 present within tension zone 310 is determined from the amount of web material previously present, plus the amount of web material added, and minus the amount of web material removed from the tension zone 310 during the time period. This value may be expressed as $$L_T=\{V_1\cdot\Delta t\cdot(1-\epsilon_1)\}-\{V_2\cdot\Delta t\cdot(1-\epsilon_2)\}+\{L_{zs}\cdot(1-\epsilon_z)\}. \qquad \text{Equation 10}$$

Once the unstrained length for the web material within tension zone 310 is known, a value for the present strain may be determined by dividing by length of the web material in tension zone 310 by the known fixed length of tension zone 310. This value for the present strain may be expressed as: $\epsilon_Z=L_T/L_z$. A value for the present tension within tension zone 310 may be determined from this value for the present strain. A calculation for the present tension present from present strain may be expressed as: $T=E\times A\times\epsilon$.

This process may readily be incorporated in controller module 130, e.g., via incorporation within a programmable logic controller, drive system, or other digital control computer. The solution interval should be set to a short period to allow high frequency updates (for example 10 ms or 100 Hz), but this interval may need to be increased for extremely fast line speeds. This process may operate using fixed-point arithmetic and carrying the remainder to provide the maximum possible accuracy. Floating point math would be easier to implement, but may require additional resources and result in reduced sampling period. A time-variant adapting to line speed would improve accuracy at low speed, with some increased complexity. The time-variant system would adapt the solution interval to optimize resolution. At higher speeds, shorter intervals could be used to increase update rate while maintaining resolution. At slow speeds a longer interval could be used to increase resolution. Bandwidth would be lower, but this is acceptable at slower speeds.

Several parameters are used to implement the above calculations. For example, the web span length and the scaling factor for web distance per counter interval may be required. The web distance per counter interval is the counts per roller revolution divided by the roller circumference. Since required accuracies on strain will often exceed 0.01%, extreme circumferential accuracy is required. This type of accuracy is often not obtainable even with the uses of large bore micrometers or pi tapes. One method to determine this constant is to temporarily mount a tension load cell in the measuring span. The ratio of tension of the present zone to the upstream zone, in conjunction with the previously defined equations, can be used to determine the present strain in this span. From the strain, the ratio of roller diameters may be determined. In a similar manner, the procedure may be repeated for all downstream web spans. Only the relative ratio of diameters is required for such a determination; the absolute value of each individual roller is not required.

The web span length determines the transient response of the sensor (see Equation 5). The length value only determines the rate at which the solution converges on the steady state value. As such, extreme accuracy is not required in most circumstances. For these cases, simple methods such as direct measurement by a tape measure, or timing a mark on the web while maintaining a fixed web velocity are sufficient. When dynamic response is critical, the time response of the measured tension for a draw step change may be used to calculate the effective span length (Equation 5).

Extremely accurate position sensors may be used to improve the accuracy of the tension calculation. In one embodiment, sine encoder based position sensors may be used. These devices employ moderate (1000–32000) native line counts of sin-cosine signals, which are further interpolated at the controller or electronics. Interpolation may be used to provide additional accuracy, often resulting in resolutions exceeding 4 million parts per roller revolution. Often, these sensors are already mounted with high performance drive systems, and only additional software is required. High-resolution sensors that employ discrete quadrature signals may also be used, but these types of sensors will not have the resolution of sine-based methods. In addition, these sensors may be rate limited due to the use of high harmonic content square wave signals.

Graduated tapes may also be applied to a roller's surface. These tapes are very easy to apply to existing equipment, but have the disadvantage of a splice with resulting loss of signal that must be addressed by the software. Traditional low-resolution sensors may be used in conjunction with high accuracy time between pulse methods. This method is less desirable as the update rate is a function of the roller velocity.

Figure 4:
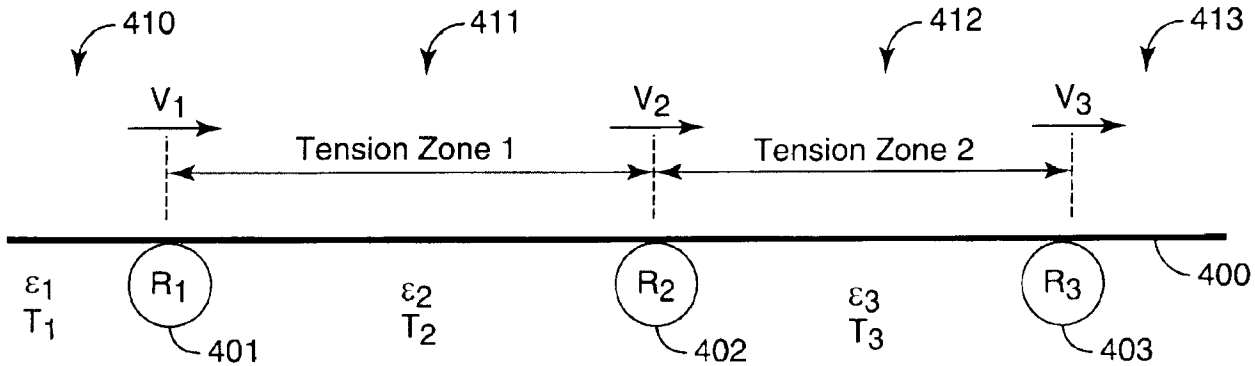
FIG. 4 is a block diagram illustrating a representation of multiple tension zones within a web-based manufacturing system.

FIG. 4 is a block diagram illustrating multiple tension zones 410–413 within a web-based manufacturing system according to an embodiment of the invention. As illustrated in reference to FIG. 4, the above described components and processes may be used in a set of adjacent tension zones 410–413 to determine the strain, tension, and related parameters of the web material 400 within one or more of the tension zones. The determination of the web parameters are calculated for a first tension zone 411 with the results of this calculation used to determine the web parameters for a second tension zone 412. These calculations are first performed on an upstream tension zone 411 and then iteratively performed on subsequent downstream tension zones 412. The upstream and downstream zones are determined from a direction of the web material 400 as it flows through the web transport system.

In order for the above calculations to be performed, a value for tension $T_1$ or strain $\epsilon_1$ must be known for time period $t_1$. This value for tension $T_1$ or strain $\epsilon_1$ may be obtained using a tension sensor, e.g., upstream tension sensor 121 of FIG. 1. Once a tension is known in one zone of the web transport system, e.g., tension zone 410, controller module 130 may use this limitative process to determine the strain and tension in all remaining downstream zones, e.g., tension zones 411–413.

Using this known value for strain $\epsilon_1(t_i)$, the unstrained amount of web material 400 may added to tension zone 411 during time period $t_i$ may be determined as discussed above. The amount of unstrained web material 400 in tension zone 411 during time period $t_i$ may be determined using strain $\epsilon_1(t_{i-1})$ that was determined in a prior time period $t_{i-1}$. Similarly, the amount of unstrained web material 400 subtracted from tension zone 411 during time period $t_i$ may be determined using strain $\epsilon_1(t_{i-1})$ that was determined in a prior time period $t_{i-1}$. These three values are then used to determine strain $\epsilon_2(t_i)$ for time period $t_i$ as discussed in detail above.

The newly determined value for strain $\epsilon_2(t_i)$ is now used to update the amount of web material added to tension zone 412 during time period $t_i$ as the above process repeats for tension zone 412. As before, the amount of unstrained web material 400 in tension zone 412 during time period $t_i$ may be determined using strain $\epsilon_2(t_{i-1})$ that was determined in a prior time period $t_{i-1}$. Again, the amount of unstrained web material 400 subtracted from tension zone 412 during time period $t_i$ may be determined using strain $\epsilon_2(t_{i-1})$ that was determined in a prior time period $t_{i-1}$. These three values are then used to determine strain $\epsilon_2(t_i)$ for time period $t_i$ as discussed in detail above. This iterative processing repeats for tension zone 413 and all subsequent tension zones in the web transport system.

Figure 5:
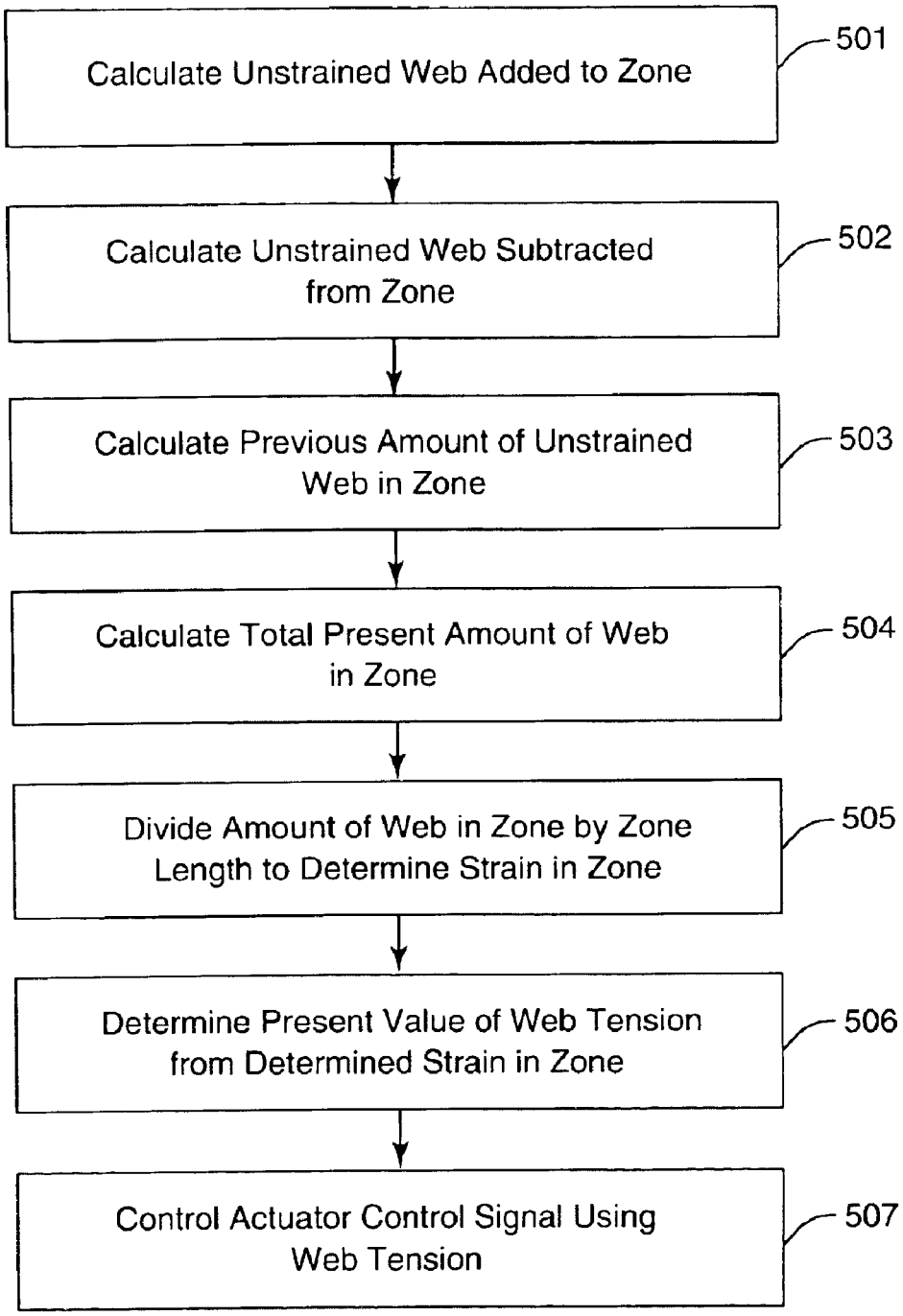
FIG. 5 is a flow chart illustrating an example mode of operation of a controller that determines web tension for a web-based manufacturing system according to an embodiment of the invention.

FIG. 5 is a flow chart illustrating an example mode of operation of controller module 130 for determining web tension for a web-based manufacturing system according to an embodiment of the invention. For exemplary purposes, FIG. 5 is described in reference to the manufacturing system of illustrated in FIG. 1.

Initially, controller module 130 calculates the amount of unstrained web material that is added to the particular tension zone (501). To perform the calculation, the amount of strained web material added to the tension zone is obtained from the position encoding sensors coupled to a first roller that defined a beginning of the tension zone in a web transport system. The amount of rotation of the first roller defines the distance along the circumference of the first roller that corresponds to the amount of strained web material added to the tension zone. Using a known value for the tension and strain for the web material in an upstream tension zone, this amount of strained web material added to the tension zone may be converted to the desired unstrained amount.

The same calculation is performed to determine the amount of unstrained web material that is subtracted from tension zone (502) using the position measurement for a second roller that defines an end of the tension zone. As above, the position information from the second roller provides an amount of strained web material removed from the tension zone. Using the previously known strain and tension for the tension zone, this amount of web material may be converted from a strained amount to an unstrained amount.

A calculation of the amount of unstrained material in the tension zone (503) is determined using the previously known strain and tension for the tension zone and a known length for the tension zone. The above three values, the amount of web material in the tension zone, the amount of web material added to the tension zone, and the amount of web material subtracted from the tension zone are combined (504) to determine an amount of web material presently in the tension zone.

From the amount of web material in the tension zone at a particular point in time, the strain in the web material (505) and the tension in the web material (506) may be easily determined as explained above in great detail. As also discussed above, additional web material parameters may be easily determined from the strain and tension determined for the web material in any particular tension zone.

Once controller module 130 determines the tension in the web material, or any of the other web material parameters, controller module 130 may adjust actuator control signal 131 (507) to adjust the speed of roller 101 or 102 as necessary to control the tension in the web material within a desired range. The above process may be iteratively repeated for any number of adjacent tension zones as discussed above in reference to FIG. 4.

Various embodiments of the invention have been described. While the above embodiments of the invention describe a system and method for determining web tension and modulus sensing within a web transport system, one skilled in the art will recognize that the use of a particular computing architecture for a data processing system are merely example embodiments of the invention. It is to be understood that other embodiments may be utilized and operational changes may be made without departing from the scope of the invention as recited in the attached claims.

As such, the foregoing description of the exemplary embodiments of the invention has been presented for the purposes of illustration and description. They are not intended to be exhaustive or to limit the invention to the precise forms disclosed. Many modifications and variations are possible in light of the above teaching. It is intended that the scope of the invention be limited not with this detailed description, but rather by the claims appended hereto. The invention is presently embodied as a method and apparatus for determining web tension and modulus sensing within a web transport system.

What is claimed is:

1. A computer-implemented method comprising:

determining an unstrained amount of web material added to a tension zone in a time period, the time period having a beginning and an end;

determining in real time a tension in the web material at the end of the time period as a function of the unstrained amount of web material added to the tension zone; and controlling a first actuator control signal for a first roller as a function of the tension in the tension zone.

2. The method according to claim 1, wherein the method further comprises:

controlling a second actuator control signal for a second roller as a function of the tension in the tension zone.

3. The method according to claim 2, wherein the tension zone corresponds to a segment of web material between the first roller and the second roller;

the first roller being driven at a first desired velocity by the first actuator control signal; and the second roller being driven at a second desired velocity by the second actuator control signal.

4. The method of claim 1, further comprising:

determining an unstrained amount of the web material in the tension zone at the beginning of the time period; and determining the tension in the web material at the end of the time period as a function of the unstrained amount of web material added to the tension zone and the unstrained amount of web in the tension zone at the beginning of the time period.

5. The method of claim 4 further comprising:

determining an unstrained amount of the web material subtracted from the tension zone in the time period; and determining the tension in the web material at the end of the time period using the unstrained amount of web material added to the tension zone, the unstrained amount of web material in the tension zone at the beginning of the time period, and the unstrained amount of web material subtracted from the tension zone.

6. The method according to claim 5, wherein the determining the tension in the web material at the end of the time period comprises:

combining the unstrained amount of the web material added to the tension zone, the unstrained amount of the web material in the tension zone at the beginning of the time period, and the unstrained amount of web material subtracted from the tension zone to determine an amount of web material in the tension zone at the end of the time period;

dividing the amount of the web material in the tension zone at the end of the time period by a length of the tension zone to determine a current strain for the web material; and converting the strain for the web material to tension.

7. The method of claim 1, further comprising:

receiving a position signal from a position sensor, wherein the position signal indicates a position of the first roller; and calculating the tension in real-time as a function of the position signal.

8. The method according to claim 1, further comprising:

receiving a position signal from a position sensor, wherein the position signal indicates a position of the first roller, and wherein determining the unstrained amount of the web material comprises determining the unstrained amount of web material added to the tension zone as a function of the position of the first roller and a tension value for an upstream tension zone.

9. The method according to claim 1, wherein the unstrained amount of web material in the tension zone is determined using a previously determined tension value for the tension zone.

10. The method according to claim 1, wherein the unstrained amount of web material added to the tension zone is determined using a position of the second roller and a previously determined tension value for the tension zone.

11. The method according to claim 1, wherein the tension in the tension zone at the end of the time period is used to determine an amount of web material added to a downstream tension zone.

12. The method according to claim 11, wherein the method further comprises:

calculating a tension for the web material in the adjacent downstream tension zone by:

determining an unstrained amount of the web material added to the adjacent downstream tension zone in the time period, the time period having a beginning and an end;

determining an unstrained amount of the web material in the adjacent downstream tension zone at the beginning of the time period;

determining an unstrained amount of the web material subtracted from the adjacent downstream tension zone in the time period;

determining the tension in the web material at the end of the time period using the unstrained amount of web material added to the adjacent downstream tension zone, unstrained amount of web material in the adjacent downstream tension zone, and unstrained amount of web material subtracted from the adjacent downstream tension zone.

13. A computer-implemented method comprising:

receiving a position signal indicating a position of a first roller in a manufacturing system for a web material;

determining a change in position of the first roller over a period of time based on the position signal;

calculating a change in length of the web material within a zone defined by the first roller and a second roller based on the determined change in position of the first roller;

calculating a property of the web material based on the change in length by:

(a) determining an unstrained amount of the web material added to the tension zone in a time period, the time period having a beginning and an end, (b) determining an unstrained amount of the web material, in the tension zone at the beginning of the time period, (c) determining an unstrained amount of the web material subtracted from the tension zone in the time period, (d) combining the unstrained amount of web material added to the tension zone, unstrained amount of web material in the tension zone, and unstrained amount of web material subtracted from the tension zone to determine an amount of web material in the tension zone at the end of the time period, and (e) dividing the amount of web material in the tension zone at the end of the time period by a length of the tension zone to determine a current strain for the web material; and (f) converting the strain for the web material to a calculated property; and outputting the calculated property of the web material.

14. The method according to claim 12, wherein the outputted calculated property is displayed to an operator.

15. The method according to claim 13, wherein the method further comprises;

controlling an actuator control signal based on the calculated property of the web material.

16. The method according to claim 15, wherein the actuator control signal varies the velocity of the first roller.

17. The method according to claim 15, wherein the actuator control signal varies the velocity of the second roller.

18. The method according to claim 15, wherein the actuator control signal varies a span length between the first roller and the second roller.

19. The method of claim 13, wherein the property comprises one of a tension of the web material, a modulus for the web material, a width of the web material, or a thickness of the web material.

20. The method according to claim 13, wherein the unstrained amount of web material added to the tension zone is determined using a position of the first roller and a tension value for an adjacent upstream tension zone at the end of the time period.

21. The method according to claim 13, wherein the unstrained amount of web material in the tension zone is determined using a previously determined tension value for the tension zone at the beginning of the time period.

22. The method according to claim 13, wherein the unstrained amount of web material added to the tension zone is determined using a position of the second roller and a previously determined tension value for the tension zone at the beginning of the time period.

23. The method according to claim 13, wherein the tension in the tension zone at the end of the time period is used to determine an amount of web material added to an adjacent downstream tension zone.

24. The method according to claim 23, wherein the method further comprises: calculating a tension for the web material in the adjacent downstream tension zone by:

determining an unstrained amount of web material added to the adjacent downstream tension zone in a time period, the time period having a beginning and an end;

determining an unstrained amount of web material in the adjacent downstream tension zone at the beginning of the time period;

determining an unstrained amount of web material subtracted from the adjacent downstream tension zone in the time period;

determining the tension in the web material at the end of the time period using the unstrained amount of web material added to the adjacent downstream tension zone, unstrained amount of web material in the adjacent downstream tension zone, and unstrained amount of web material subtracted from the adjacent downstream tension zone.

25. A computer-readable medium comprising instructions for causing a programmable processor to:

receiving a first position corresponding to a position of a first roller;

receiving a second position corresponding to a position of a second roller; and calculating a parameter for a segment of web material in real time using the first position and the second position by;

determining an unstrained amount of web material added to a tension zone defined by the first roller and the second roller in a time period, the time period having a beginning and an end;

determining an unstrained amount of web material in the tension zone at the beginning of the time period;

determining an unstrained amount of web material subtracted from the tension zone in the time period; and determining the parameter of the web material at the end of the time period using the unstrained amount of web material added to the tension zone, unstrained amount of web material in the tension zone, and unstrained amount of web material subtracted from the tension zone.

26. The computer-readable medium according to claim 25, wherein the determining the parameter of the web material at the end of the time period comprises:

combining the unstrained amount of web material added to the tension zone, unstrained amount of web material in the tension zone, and unstrained amount of web material subtracted from the tension zone to determine an amount of web material in the tension zone at the end of the time period;

dividing the amount of web material in the tension zone at the end of the time period by a length of the tension zone to determine a current strain for the web material; and converting the strain for the web material to the parameter.

27. The computer-readable medium according to claim 25, wherein the unstrained amount of web material added to the tension zone is determined using a position of the first roller and a parameter value for an adjacent upstream tension zone at the end of the time period.

28. The computer-readable medium according to claim 25, wherein the unstrained amount of web material in the tension zone is determined using a previously determined parameter value for the tension zone at the beginning of the time period.

29. The computer-readable medium according to claim 25, wherein the unstrained amount of web material added to the tension zone is determined using a position of the second roller and a previously determined parameter value for the tension zone at the beginning of the time period.

30. The computer-readable medium according to claim 25, wherein at the end of the time period the parameter is used to determine an amount of web material added to an adjacent downstream tension zone.

31. The computer-readable medium according to claim 30, wherein the method further comprises:

calculating a parameter for the web material in the adjacent downstream tension zone by:

determining an unstrained amount of web material added to the adjacent downstream tension zone in a time period, the time period having a beginning and an end;

determining an unstrained amount of web material in the adjacent downstream tension zone at the beginning of the time period;

determining an unstrained amount of web material subtracted from the adjacent downstream tension zone in the time period;

determining the parameter of the web material at the end of the time period using the unstrained amount of web material added to the adjacent downstream tension zone, unstrained amount of web material in the adjacent downstream tension zone, and unstrained amount of web material subtracted from the adjacent downstream tension zone.

32. A system comprising:

at least two position sensors generating respective position signals, each position sensor being coupled to a respective roller in a web transport system;

a controller module that calculates a tension for web material based upon the two position signals, and outputs an actuator control signal based upon the calculated tension, wherein the controller module calculates the tension for the web material in a tension zone formed by the rollers coupled to the at least two position sensors by;

determining an unstrained amount of web material added to the tension zone in a time period, the time period having a beginning and an end;

determining an unstrained amount of web material in the tension zone at the beginning of the time period;

determining an unstrained amount of web material subtracted from the tension zone in the time period; and determining the tension in the web material at the end of the time period using the unstrained amount of web material added to the tension zone, unstrained amount of web material in the tension zone, and unstrained amount of web material subtracted from the tension zone.

33. The system according to claim 32, wherein the determining the tension in the web material at the end of the time period comprises:

combining the unstrained amount of web material added to the tension zone, unstrained amount of web material in the tension zone, and unstrained amount of web material subtracted from the tension zone to determine an amount of web material in the tension zone at the end of the time period;

dividing the amount of web material in the tension zone at the end of the time period by a length of the tension zone to determine a current strain for the web material; and converting the strain for the web material to tension.

34. The system according to claim 33, wherein the unstrained amount of web material added to the tension zone is determined using a position of the first roller and a tension value for an adjacent upstream tension zone at the end of the time period.

35. The system according to claim 33, wherein the unstrained amount of web material in the tension zone is determined using a previously determined tension value for the tension zone at the beginning of the time period.

36. The system according to claim 33, wherein the unstrained amount of web material added to the tension zone is determined using a position of the second roller and a previously determined tension value for the tension zone at the beginning of the time period.

37. The system according to claim 33, wherein the tension in the tension zone at the end of the time period is used to determine an amount of web material added to an adjacent downstream tension zone.

* * * * *